United States Patent [19]

Zimmerman

[11] 4,007,376

[45] Feb. 8, 1977

[54] VIDEO X-RAY IMAGING SYSTEM AND METHOD

[76] Inventor: Samuel Morton Zimmerman, 3530 Forest Lane, Suite 98, Dallas, Tex. 75234

[22] Filed: Aug. 7, 1975

[21] Appl. No.: 602,811

[52] U.S. Cl. ..... 250/416 TV; 178/DIG. 5

[51] Int. Cl.[2] ..... H05G 1/30

[58] Field of Search ..... 250/416, 416 TV, 402, 250/314; 178/DIG. 5

[56] References Cited

UNITED STATES PATENTS

| | | | |
|---|---|---|---|
| 2,667,585 | 1/1954 | Gradstein | 250/416 TV |
| 3,009,079 | 11/1961 | Jacobs | 250/416 TV |
| 3,271,608 | 9/1966 | Rome et al. | 250/416 TV |

OTHER PUBLICATIONS

"Amplifying and Intensifying the Fluoroscopic Image by Means of a Scanning X-ray Tube," Moon, Science, Oct. 1950, vol. 112, pp. 389–395.

*Primary Examiner*—Alfred E. Smith
*Assistant Examiner*—B. C. Anderson
*Attorney, Agent, or Firm*—Peter J. Murphy

[57] ABSTRACT

An x-ray generator tube which includes an electron gun for directing a focused high energy electron beam toward an anode presenting an enlarged face inclined relative to the electron beam; with the tube having deflection coils for sweeping the beam across the enlarged anode face producing a moving focal spot. The tube envelope provides a shielded point-source window oriented with respect to the anode to pass only a thin beam of the x-rays which are generated at the moving focal spot, thereby producing a sweeping beam of x-rays. The sweeping x-ray beam is directed through the subject to an x-ray sensitive video pickup tube which is similar to a TV camera pickup tube, and which includes a face plate having a mosaic of chemically treated globules sensitive to x-rays which produces an electric image corresponding to the x-ray image produced by the sweeping x-ray beam passing through the subject being x-rayed. This mosaic is scanned and the pickup tube produces a video output signal in a conventional manner.

17 Claims, 4 Drawing Figures

VIDEO X-RAY IMAGING SYSTEM AND METHOD

BACKGROUND AND SUMMARY OF THE INVENTION

This invention relates to a system and method for producing instantaneous x-ray pictures of a subject by generating a narrow, sweeping beam of x-rays to irradiate a subject, and detecting the x-rays by means of an x-ray sensitive video pickup tube which produces a video signal for presentation of an instantaneous picture on a video monitor, or for recording.

A principal object of this invention is to provide an x-ray imaging system and method wherein the exposure of the subject to radiation is substantially reduced.

Another object of this invention is to provide an x-ray imaging system and method for producing an instantaneous video image of the subject.

Another object of this invention is to provide an x-ray imaging system and method which can produce a single picture, sequential pictures, or continuous pictures without film.

Still another object of this invention is to provide an x-ray imaging system and method which produces a video signal of the x-ray picture enabling instantaneous video presentation and/or recording of the video signal on magnetic tape or on video discs for later selective presentation.

A further object of this invention is to provide an x-ray imaging system and method producing an instantaneous and varying video representation of a moving subject.

A still further object of this invention is to provide a system and method for producing improved x-ray images of subjects, whether human or inanimate.

Another object of this invention is to provide an x-ray imaging system and method wherein a very narrow x-ray beam is produced to sweep the subject in a controlled scan, and wherein the sweeping x-ray beam is detected on an x-ray sensitive video pickup tube by a sweeping electron beam controlled in synchronism with the sweeping x-ray beam.

Still another object of this invention is to provide an x-ray imaging system and method for producing instantaneous video images having very high resolution.

These objects are achieved in a system and method which includes an x-ray generating tube for generating a controlled narrow sweeping beam of x-rays, and a video pickup tube for detecting the x-radiation. The x-ray generating tube includes means for generating a focused high energy electron beam; an anode having an enlarged face disposed to be impinged by the electron beam; a system for deflecting the electron beam to sweep the anode face producing a moving focal spot; and means defining a shielded point-source window in the tube envelope. The anode face is oriented relative to the generated electron beam and to the window, to direct generated x-rays from the moving focal spot to the window, thereby radiating a narrow moving beam of x-rays. The video pickup tube includes a face plate having a mosaic of x-ray-sensitive globules responsive to x-radiation to produce an electric image corresponding to the density of x-rays passing through an irradiated subject; means for producing a focused electron beam directed to the face plate; and means for deflecting the electron beam to sweep said face plate. Control circuit means include means for synchronizing the sweep of the video pickup tube electron beam and the sweep of the x-ray generating tube electron beam whereby the video pickup tube produces a video output signal for feeding a video monitor to produce the generated x-ray picture.

The advantages of the invention as well as additional objects thereof will be understood more fully from the following description when read in connection with the accompanying drawing.

DRAWING

DESCRIPTION OF THE PREFERRED EMBODIMENT

Figure 1:
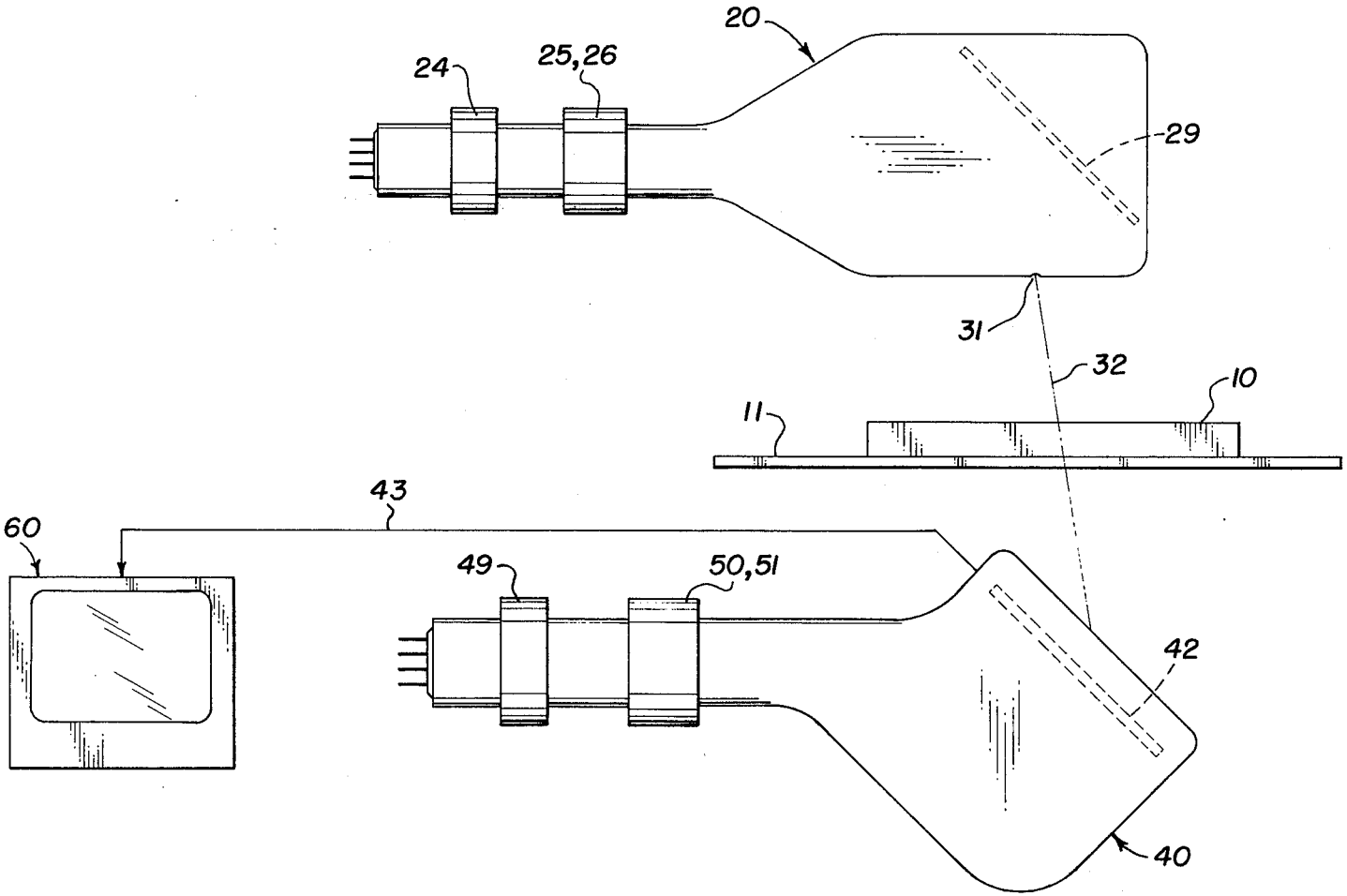
FIG. 1 is a diagrammatic representation of an x-ray imaging system according to the invention.

The basic components of the system are illustrated diagrammatically in FIG. 1 for producing video x-ray pictures of a subject 10 supported on an appropriate supporting table 11. The subject may be a human subject, or any other animate or inanimate subject for which x-ray analysis is useful.

An x-ray generator, illustrated by an x-ray tube 20, is supported above the table 11 and would preferably be supported in a manner to be adjustable in three dimensions relative to the support table for irradiating the desired portion of the subject.

An x-ray pickup tube 40 is mounted beneath the table 11, and is also preferably adjustably mounted for selective positioning relative to the x-ray tube 20 and the table 11. The pickup tube 40 functions in a manner similar to known television picture or pickup tubes, but is responsive to x-radiation (and shielded from light) to produce an output video signal which corresponds to a detected electrical image produced by the x-radiation.

The above described basic components along with associated circuitry will be referred to for convenience as x-ray apparatus; and this apparatus produces a video output signal which can be visually presented on conventional video monitors or receivers. The x-ray apparatus includes circuitry, discussed subsequently, for producing blanking and synchronizing pulses, and horizontal and vertical sweep signals, and synchronizing means for these pulses and signals, and means for transmitting from the x-ray apparatus a composite video signal.

The video signal from the x-ray apparatus is then transmitted to a conventional video receiver or monitor 60 which presents the video x-ray picture. The video output signal from the pickup tube 40 may of course be transmitted to other monitors located remotely from the video pickup tubes; and of course a video signal may be broadcast by means of conventional transmitters and antenna systems and circuitry to remote video receivers.

The x-ray generating tube 20 is similar to known high vacuum x-ray generating tubes only in that a high energy, focused electron beam is produced and directed toward a focal spot on a metal anode, thereby producing x-radiation which passes through a shielded control window in the tube envelope to irradiate the subject. The x-ray tube of this invention differs from conventional tubes in that the anode, which may be fixed, adjustable or rotatable, is relatively large presenting a generally rectangular impingement face which is inclined relative to the electron beam; that the electron beam is focused to a very fine or narrow beam; that the tube includes a deflection system for causing the beam to sweep or scan the anode face in the manner of an electron beam of a cathode ray tube, thereby producing a moving focal spot on the anode face; and that the x-radiation emitted from the moving focal spot passes through a very small point-source window in the tube envelope which permits passage of only a very narrow beam of x-rays; and the emission of x-rays from the moving focal spot through the point-source window produces a narrow sweeping beam of x-rays which moves in a manner corresponding to the movement of the electron beam. If the electron beam then is controlled to scan the target anode in a programmed manner (similar to the scanning of the target anode in a television picture tube), the generated x-ray beam will scan the subject in a corresponding manner, and the x-rays (modulated by the subject) may be detected in an appropriate pickup tube generally similar to a television camera tube having a scanning electron beam which is swept in synchronism with the electron beam of the x-ray generator tube.

Figure 2:
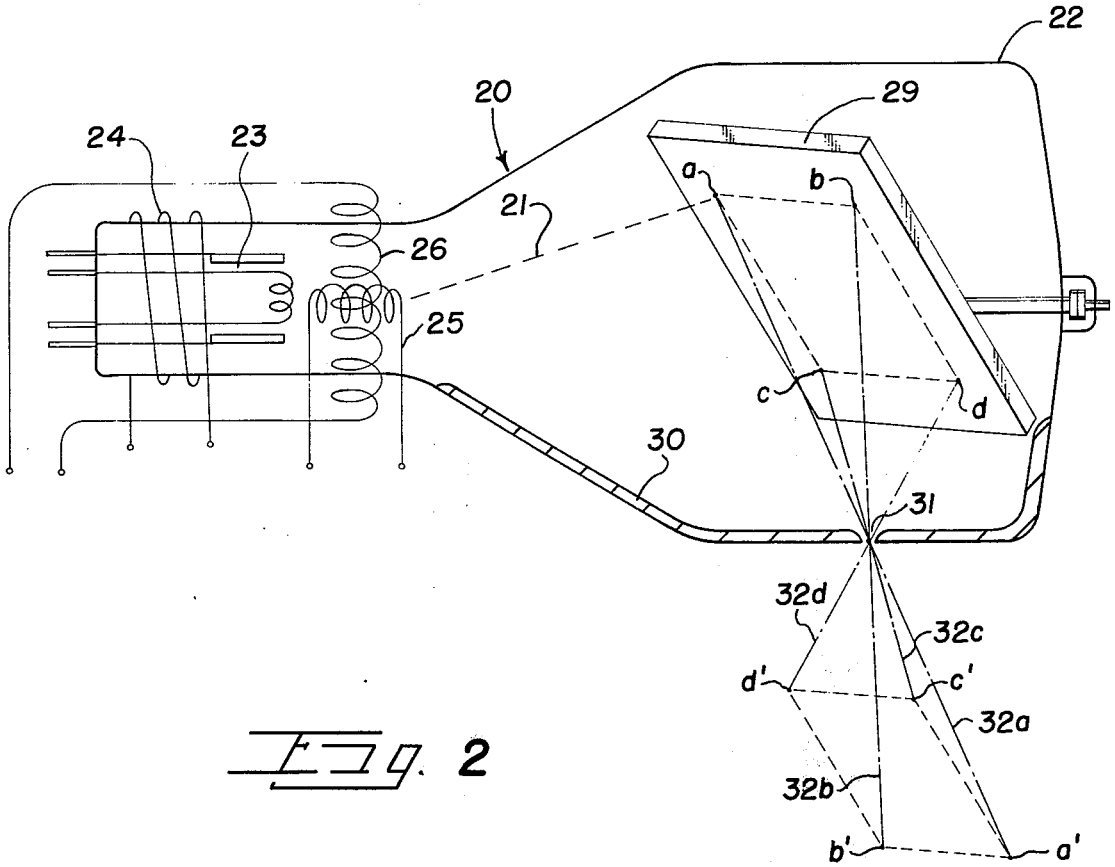
FIG. 2 is a diagrammatic and schematic representation of an x-ray tube generator for use in the system of FIG. 1.

As illustrated in FIG. 2 the x-ray tube 20 includes a glass envelope 22 evacuated to high vacuum. An electron gun 23, in the tube neck, may consist of a tungsten wire wound, high temperature cathode which may be excited by a variable voltage of from 2.5 to 10 volts, up to 6 amps, which generates an electron beam 21 of high energy. The tube may include a focusing coil 24; and an electromagnetic focusing coil may for example consist of several hundred pile wound concentric turns of copper wire to which a variable DC voltage of from 50 to 600 volts may be applied, for very fine focus of the beam.

The tube includes a deflection system for producing horizontal and vertical sweep of the electron beam 21; and, by way of example, the deflection system may be electromagnetic including a horizontal deflection coil 25 and a vertical deflection coil 26. The horizontal deflection coil may be a wire wound coil excited by either a saw-tooth or square wave pulse of electrical voltage at a variable rate of between 7500 and 63,000 hertz for deflecting the high energy electron beam. The vertical deflection coil may be a wire wound coil excited by either a saw-tooth or square wave pulse of electrical voltage at a variable rate of between 25 and 480 hertz. The voltage amplitudes of the saw-tooth or square wave pulses are variable from 20 volts peak-to-peak to several thousand volts.

The tube components, some of which are described above, for producing, focusing, accelerating, deflecting or otherwise controlling the electron beam may follow known technology in x-ray generating tubes and/or cathode ray tubes, modified as required to focus and control an electron beam of higher energy than that of usual cathode ray tubes.

The anode 29, illustrated in the form of a flat plate, is a high atomic weight metal anode which is excited by DC voltage of from 10 to 2000 KV at 1 to 10 ma. The anode may be fabricated for example from copper, tungsten, aluminum, platinum, silver or gold depending on the specific x-ray requirements. The anode may present, to the electron beam, a scanning face having an aspect ratio of 3:4 for example. Depending upon the application for which a system is designed, the anode may present a scanning area as small as 3 by 4 inches or as large as 36 by 40 inches for example. The anode is supported from the tube envelope by means of an insulated high voltage connector, which may be adapted to an adjustment for varying the position and angle of the anode or may be adapted to a motion for rotation of the anode.

The variation of the anode voltage will cause variation in the speed of bombardment of the anode by the electron beam, and therefore will cause a variation in the density, wave length and intensity of the emitted x-rays. This wave length will vary from the longest wave equal to 1000 angstroms to a short wave of $0.00001 \times 10^{-8}$ or $10^{-5}$ angstroms.

The random emission and scatter of x-rays from the anode is prevented from passing through the tube envelope by means of conventional lead shielding 30; and a small opening in this shielding, appropriately placed relative to the face of the anode 29 provides a point-source window 31 which permits the passage of only a narrow beam 32 of x-rays from the generator tube. The direction of the x-ray beam 32 passing from the tube is determined by a line between the moving focal spot 33 on the anode 29 and the point-source window 31.

While in the drawings the face of the anode 29 is shown angled at approximately 45° relative to the electron beam 28, and the generated x-ray beam passes from the tube generally at an angle of about 90° relative to the electron beam, these relationships are indicated only by way of example. Similarly in the diagrammatic illustrations of FIGS. 1 and 2, the face plate 42 of the pickup tube is shown at an angle in relation to the incidence of the x-ray beam, and generally parallel to the generator tube anode. These relationships again are only by way of illustration; and it may well be that the components of the generator tube may be arranged that the generated x-ray beam is more nearly normal to the anode, and that the angle of incidence of the x-ray beam to the pickup tube target plate is approximately 90°.

Figure 3:
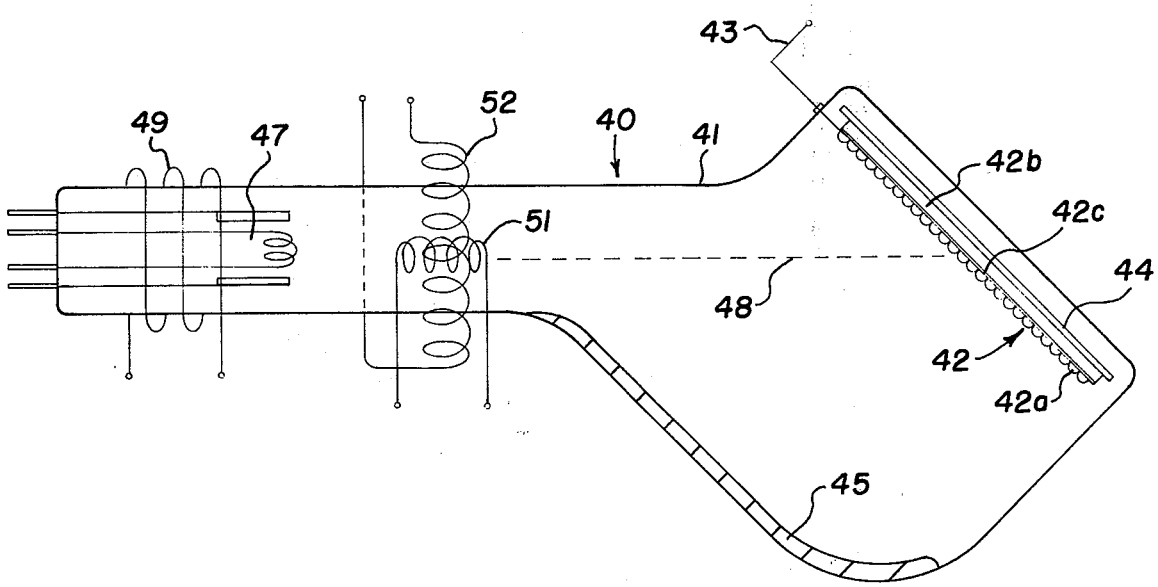
FIG. 3 is a diagrammatic and schematic representation of an x-ray pickup tube for use in the system of FIG. 1.

FIG. 3 is a diagrammatic and schematic illustration of the pickup tube 40, which is similar in many ways to an iconoscope television camera pickup tube, and which receives and detects the sweeping x-ray beam to produce an "electric image" corresponding to the varying density of the x-radiation passing through the subject. The pickup tube is a high vacuum tube enclosed in a glass envelope 41. A generally rectangular face plate 42 is mounted within the tube, having on its inner face a mosaic of thousands or millions of x-ray sensitive globules **42*a* insulated from each other on a conductive signal plate 42*b* formed on an insulating base 42*c* such as mica for example. These globules preferably may be photo diode globules coated with cesium, antimony trisulphide, barium platinocyanide or other similar chemical compounds which are sensitive to x-rays; that is, the photo-sensitive properties are a response to x-radiation rather than to light. The signal plate 42*b* is connected to the pickup tube output lead 43.**

The pickup tube 40, its target plate and associated components may be designed to employ either photo-emissive or photo-conductive properties of the x-ray sensitive coated globules to produce the electric image corresponding to the varying density of x-radiation.

video amplifier 82 may be fed to a video tape recorder 85 for producing a permanent recording of the x-ray image for later reproduction on a video monitor.

OPERATION

The operation of the system and method will now be described briefly. The electron guns and the deflection circuits for both the x-ray tube and the video pickup tube are controlled in synchronization; with the beams being blanked out by means of the blanking pulse signal at the appropriate time for the retrace intervals for the electron beams both horizontally and vertically. For the x-ray tube, then, the generation of x-rays ceases during the blanking intervals; and, correspondingly, for the pickup tube the video signal is blanked out during these intervals.

With particular reference to FIG. 2, the scan area of the face of the anode 29 is generally rectangular in shape and is designated by the letters *a*, *b*, *c* and *d*. For the scanning of this scan area by the electron beam 21, the beam is preferably deflected in the manner to scan horizontal lines beginning with the line *a-b* and successive horizontal lines ending approximately with the line *c-d*. Preferably the scan area may be scanned with interlacing fields, in the manner of conventional television scanning in the United States, so that the electron beam is deflected vertically and retraced twice for each scanning frame. Alternatively other types of scanning is permissible including rotational, trapezoidal and combinations; and other television type standards such as the European television system scans.

In FIG. 2 there is illustrated, in phantom, a scanning area *a'*, *b'*, *c'*, *d'* which represents the generally rectangular scanning area of the pickup tube face plate 42. The x-ray beam 32 is illustrated in four different orientations 32*a*, 32*b*, 32*c*, and 32*d* emanating from four distinct focal spots, *a*, *b*, *c* and *d* on the anode. The x-rays propagated from the focal spot *a* radiate randomly from this focal spot; however only a narrow beam of x-rays is permitted to pass through the point-source window 31 to define the beam 32*a* which excites the globules at the point *a'* on the face plate. As the focal spot moves from *a* to *b*, the generated x-ray beam effectively moves from the point *a'* to *b'* on the face plate thereby sweeping the face plate and exciting a horizontal line of globules 42*a*. The x-ray tube then produces a sweeping or scanning x-ray beam 32 which scans the face plate 42 in a manner directly corresponding to the sweeping of the anode by the electron beam 21.

In the pickup tube, the electron beam is controlled to scan the face plate area *a'*, *b'*, *c'*, *d'* in synchronization with the x-ray beam 32, so that the electric image produced on the face plate 42 by the x-radiation is immediately detected by the pickup tube and converted to a corresponding video output signal.

For a given system according to the invention, the scan area of the pickup tube face plate would be fixed; and it would normally be desirable to scan the full scan area of the face plate. The scan area of the x-ray beam would be controlled by the distance between the x-ray tube and the video pickup tube and also by the physical distance, within the x-ray tube, between the anode face and the point-source window 31. This relationship would be fixed in a given system; however further control of the x-ray beam scan may be achieved by varying the deflection voltages for the x-ray tube to change the effective size of the anode scan area *a*, *b*, *c*, *d*.

With respect to the area of the subject to be x-rayed with a given system, this would be controlled primarily by the position of the supporting table 11 relative to the x-ray tube and to the video pickup tube and suitable, preferably three dimensional mechanical adjustments would be provided in a given system for adjusting this physical relation.

With this system the scan raster or scanning areas for the x-ray tube anode are variable as to quantity and size of scanning lines, scanning fields and scanning frames, as well as the size of the focal spot.

What has been described is a unique x-ray video imaging system and method for use in an x-ray facility which will produce instantaneously a video signal which may be directly fed to a video monitor, and thereby immediately present a high quality, good resolution, good grey scale rendition television picture utilizing the principles of black and white television. The resolution achieved results, in part, from the number of horizontal lines scanned on the video pickup tube and the number of x-ray sensitive globules which are scanned in a given horizontal line; and the resolution which is available from existing technology in pickup tubes is adequate. A principal aspect of the reproduction of good grey scale rendition results from the sensitivity of the system, in that the information presented to the pickup tube face plate by the very narrow x-ray beam, modulated by the subject, presents discrete information to the globules in programmed sequence; and this information is instantaneously detected by the pickup tube and its sweeping electron beam so that the output signal from the pickup tube is not distorted by information on globules adjacent to those scanned by the electron beam. Additionally, with the x-ray beam being very narrow, the detection of the x-radiation by the globules is not distorted by bombardment or the scatter effect of extraneous x-rays.

The video picture is responsive, with absolutely no time delay, to the x-ray scanning of the subject being investigated, such as a human patient for which observation of internal organs may be required. In effect, the system permits instantaneous live telecasting of the subject to be viewed or investigated; and any movement of the subject, such as a human patient, will not distort or degrade the instantaneous picture quality viewed on the monitor. For example, were the human patient to swallow food, this system would permit live telecast viewing of the total action and reaction within the human organic structure as it happens.

A particularly important advantage of the invention has to do with the reduction of x-radiation required to produce the high resolution x-ray pictures; and this is particularly important with respect to human or animal subjects. Because of the extreme sensitivity of the system, and because only a narrow beam of x-rays is radiated from the x-ray tube as opposed to a broad beam of x-rays, the amount of radiation produced instantaneously at the anode may be significantly reduced and of course the amount of radiation from the tube point-source window is reduced; and this may have the effect of reducing the amount of ultimate radiation absorbed by the subject by as much as 75% in relation to the amount of radiation required for production of a comparable x-ray picture using existing conventional x-ray systems. Since the amount of x-radiation produced at the anode may be reduced, the power required for operating the x-ray generating tube may also be reduced.

The face plate 42 is disposed adjacent to one end of the tube envelope with the mica base being the outer side exposed to x-radiation which will pass through the plate to excite the globules 42*a*. A glass plate 44, which is opaque to light, may be placed between the tube envelope and the face plate 42 to prevent excitation of the globules by extraneous light; alternatively, all or a part of the tube envelope may be fabricated from opaque glass. On the face of the envelope opposite from the face plate 42 is a lead shield 45 to prevent undesirable x-radiation from the pickup tube.

The tube envelope includes an enlarged head containing the above described element and is arranged with a neck having an axis passing through the approximate center of the face plate 42 and angled relative to the face plate and the neck contains an electron gun 47 generating a very low energy electron beam 48. The gun includes a focusing system or coil 49; and associated with the tube are horizontal deflection coils 50 and vertical deflection coils 51, which may be either electrostatic plates of metal or electromagnetic deflection coils, functioning in a conventional manner to effect horizontal and vertical sweep of the electron beam 48. The tube neck is angled with respect to the face plate, so that the tube face plate may be oriented generally perpendicular to the angle of incidence of the x-rays, with the tube neck and its associated components being displaced to one side and thereby shielded from the x-radiation.

The electron gun 47 may consist of a wire wound high temperature cathode which is excited by a variable voltage of 2.5 to 6 volts, up to 4 amps, which generates an electron beam of low energy; and the gun may further include an acceleration anode for initial acceleration of the electron beam. The focusing coil 49 may be a wire wound coil into which a variable DC voltage from 10 to 100 volts is applied for fine focusing of the low energy electron beam. The horizontal deflection coil 50 may be a wire wound coil into which either a saw-tooth or square wave pulse of voltage at a variable rate of between 7500 and 63,000 hertz is applied. The vertical deflection coil 51 may be a wire wound coil into which either a saw-tooth or square wave pulse of voltage at a variable rate of between 25 and 120 hertz is applied.

The deflection systems for the x-ray tube 20 and the pickup tube 40 are controlled in synchronization with each other so that the sweeping of the pickup tube face plate by the electron beam 48 will be exactly synchronized and coordinated with the sweeping of the x-ray tube anode by the electron beam 21; and therefore the sweeping of the x-ray tube face plate by the x-ray beam 32 emitting from the apparent point-source 31 will also be in exact synchronization and coordination with the sweep of the electron beam 48. The method of scanning, that is the inter-relation of the horizontal and vertical sweep may preferably be the same as that employed in conventional television video transmission including interlaced fields. As the charges on the thousands of globules 42*a* are charged in response to detected x-rays passing through the subject, these changing charges are detected by the scanning electron beam 48 in a manner known in television camera pickup tubes; with the varying charge detected by the sweeping beam appearing as a current variation through the cathode-to-face plate return circuit.

Figure 4:
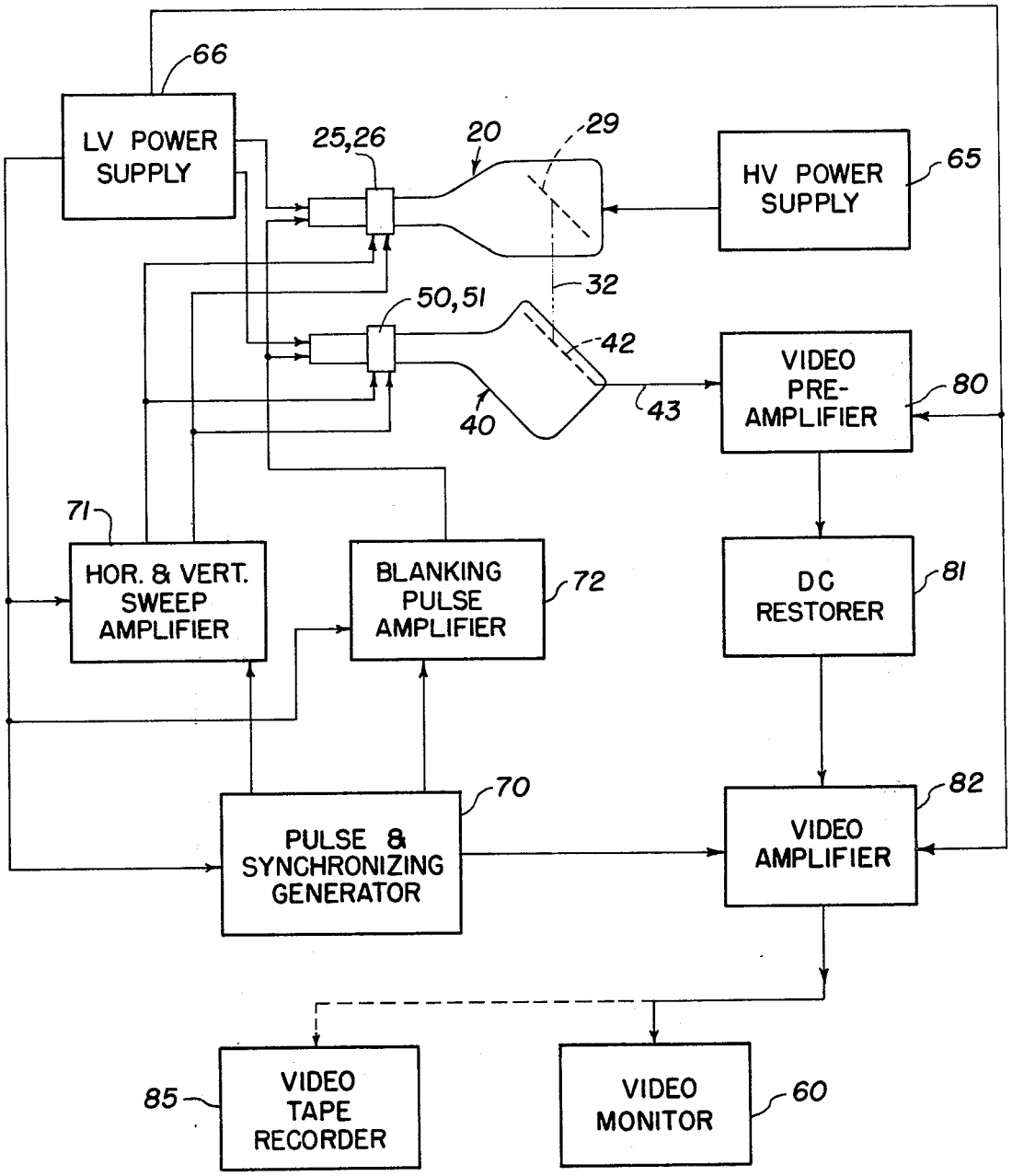
FIG. 4 is another diagrammatic representation of the system including block diagram circuitry for the system.

FIG. 4 illustrates diagrammatically an overall video-x-ray imaging system according to the invention, including system circuitry shown in block diagram form. The several circuits so illustrated and the associated functions are known in x-ray systems and in closed circuit video systems, and function to control the system as will be described.

Referring to the drawing, a high voltage regulated power supply 65 supplies the x-ray tube anode 29. This power supply 65 preferably consists of solid state circuitry (and in some cases mercury vapor vacuum tubes), the output voltage being variable from 10KV to 2000 KV at current capacities up to 20 ma. The input either may be 117 volts, 50 to 60 hertz or 220 volts, 50 to 60 hertz. A low voltage regulated power supply 66 provides power for energizing the electron guns of both the x-ray tube 20 and the video pickup tube 40; and further provides power for the pulse and synchronizing generator, the horizontal and vertical sweep amplifiers, the blanking pulse amplifier, and the video amplifiers. The low voltage power supply 66 preferably consists of solid state circuitry producing variable output voltages from 10 volts DC to 600 volts DC with capacity up to 1000 ma and producing alternating current voltages variable between 2.5 volts and 12 volts with capacity up to 12 amps. The input may be 117 volts, 50 to 60 hertz, or 220 volts, 50 to 60 hertz.

A pulse and synchronizing generator 70 preferably consists of solid state circuitry containing special oscillators and multi-vibrators for producing saw-tooth and square wave pulses of variable voltage amplitude and frequency ranging from 25 hertz to 63,000 hertz; and this circuit produces the sweep signal pulses, and the blanking and synchronizing pulses for controlling the sweep signal pulses delivered to the deflection coils, and which are incorporated in the composite video output signal.

The horizontal and vertical sweep amplifier 71 includes amplifiers designed to amplify and deliver, to the deflection yoke assemblies of both the x-ray tube 20 and the video pickup tube 40, saw-tooth and square wave voltage pulses equivalent to the variable frequencies triggered by the pulse and synchronizing generator 70, with the capability of producing amplitudes as high as 1000 volts peak-to-peak.

A blanking pulse amplifier 72 preferably includes solid state circuitry, and is provided for delivering blanking voltage pulses to the cathodes of the x-ray tube 20 and the pickup tube 40 for establishing the proper scanning retrace signals.

The output signal from the face plate 42 of the video pickup tube 40 is fed first to a video pre-amplifier 80 which preferably consists of all solid state circuitry, and is designed to accept the very low level output signal from the pickup tube, which includes blanking pulses, and which will deliver an output signal of at least 0.1 volt peak-to-peak.

The video pre-amplifier output is fed to a DC restorer circuit 81 preferably including all solid state components, for re-establishing a DC component in the video signal which is the blanking reference level.

The output signal from the DC restorer 81 is then fed to a video amplifier 82, again preferably consisting of all solid state circuitry for producing at its output a composite video signal at 1 volt peak-to-peak into a 75 ohm impedance load for delivery to a video monitor 60 for visual presentation. Synchronizing signals from the pulse and synchronizing generator may also be fed to the video amplifier 82 to complete the composite video output signal. Alternatively the output signal from the While a preferred embodiment of the invention has been illustrated and described, it will be understood by those skilled in the art that changes and modifications may be resorted to without departing from the spirit and scope of the invention.

What is claimed is:

1. A system for producing a video image of an x-ray irradiated subject comprising, in combination an x-ray generating tube including: an envelope; means for producing a focused high energy electron beam; an anode presenting an enlarged face disposed to be impinged by said electron beam; means for deflecting said electron beam to sweep said anode face, producing a moving focal spot; means defining a point-source window in said tube envelope; said anode face being oriented, relative to the produced electron beam and to said window, to direct generated x-rays from the moving focal spot to said window, thereby radiating a narrow sweeping beam of x-rays from said window;

a pickup tube, for detecting x-radiation, including: a face plate having a mosaic of x-ray sensitive globules responsive to x-radiation to produce an electric image corresponding to the density of x-rays passing through an irradiated subject; means for producing a focused electron beam directed to said face plate; means for deflecting said electron beam to sweep said face plate;

circuit means including means for synchronizing the sweep of the pickup tube electron beam with the sweep of the x-ray generating tube electron beam, and therefore with the sweep of said x-ray beam, whereby said pickup tube produces a video output signal for feeding to a video monitor to produce an x-ray picture.

2. A system as set forth in claim 1 said x-ray tube anode being a high atomic weight metal anode, excitable by DC voltage of between 10 and 2000 KV.

3. A system as set forth in claim 1 said point-source window being defined by an opening in a lead shield; said shield opening being configured and oriented relative to said anode to pass only a narrow beam of x-rays which emanates directly from a focal spot on said anode.

4. A system as set forth in claim 1 said x-ray tube electron beam generating means comprising: an electron gun consisting of a wire wound high temperature cathode which is excitable by a variable voltage of 2.5 to 10 volts up to 6 amps for generating an electron beam of high energy; and a wire wound focusing coil capable of being impressed with 50 to 600 volts for fine focus of the electron beam.

5. A system as set forth in claim 1 said x-ray tube beam deflecting means comprising: a wire wound vertical deflection coil excitable by either a saw-tooth or square wave voltage pulse at a variable rate of between 25 and 480 hertz; and a wire wound horizontal deflection coil excitable by either a saw-tooth or square wave voltage pulse at a variable rate of between 7500 and 63000 hertz.

6. A system as set forth in claim 1 said pickup tube face plate having a mosaic of many thousands of x-ray sensitive globules mounted in relation to a conductive signal plate so that each globules produces an electric charge in response to incident x-radiation, which charge is detectable through current flow in said signal plate created by impingement of said globules with an electron beam.

7. A system as set forth in claim 6 said x-ray sensitive globules being cesium coated globules.

8. A system as set forth in claim 6 said x-ray sensitive globules being coated with antimony trisulphide.

9. A system as set forth in claim 6 said x-ray sensitive globules being coated with barium platinocyanide.

10. A system as set forth in claim 1 said pickup tube electron beam generating means including a wire wound high temperature cathode which is excitable by a variable voltage of 2.5 to 6 volts.

11. A system as set forth in claim 1 said pickup tube deflecting means comprising: a wire wound horizontal deflection coil into which either a sawtooth or square wave voltage pulse at a variable rate of between 7500 and 63,000 hertz is applied; and a wire wound vertical deflection coil into which either a saw-tooth or square wave voltage pulse at a variable rate of between 25 and 120 hertz is applied.

12. A system as set forth in claim 1 said circuit means including means for generating control pulses for the electron beam deflecting means for both said x-ray generating tube and said pickup tubes; means for generating blanking and synchronizing pulses for blanking the electron beam generation and controlling said control pulses in synchronization therewith; said circuit means producing a composite video signal as the output from said pickup tube, said composite video signal including video information and blanking and synchronizing information enabling reproduction of a video picture on a video monitor.

13. A method for producing a video image of an x-ray irradiated subject including the steps:

scanning an anode face in an x-ray generating tube with a narrow electron beam in a programmed manner, to produce a moving focal point on said anode face;

directing the x-rays generated at said anode face to a point-source window of said generating tube, oriented in relation to said anode face to radiate x-rays in a narrow moving beam defined by the moving focal spot and point-source window, to thereby produce a sweeping x-ray beam;

directing said sweeping x-ray beam through the subject;

detecting the x-ray beam, modulated by the subject, by means of a pickup tube having an x-ray sensitive layer, to produce an electric image at said layer responsive to the modulated, sweeping x-ray beam;

and scanning said x-ray sensitive layer of said pickup tube with an electron beam, in synchronism with and substantially simultaneously with the sweeping of said layer by said x-ray beam, thereby producing a video output signal corresponding to said electric image.

14. A method as set forth in claim 13 including detecting said x-ray beam by means of a pickup tube face plate carrying many thousands of discrete x-ray sensitive globules;

and scanning said discrete globules with said pickup tube electron beam.

15. In a system for producing a video image of an x-ray irradiated subject, a pickup tube for detecting x-radiation comprising an envelope; a face plate within said envelope carrying a mosaic of x-ray sensitive globules, responsive to x-radiation to produce an electric image through electron emission corresponding to the density of x-rays impinging thereon; means for producing a focused electron beam directed to said face plate; means for deflecting said electron beam to sweep said face plate in a predetermined pattern; and circuit means responsive to the sweeping of said face plate by said electron beam for producing a current flow responsive to the electric image thereon, said current flow being detectable as a pickup tube output signal for feeding to a video monitor to produce a video image of the irradiated subject.

16. A pickup tube as set forth in claim 15 said globules being coated with a material selected from a group consisting of cesium, antimony trisulphide, and barium platinocyanide.

17. A pickup tube as set forth in claim 15 said face plate being disposd adjacent to one wall of said envelope;

x-ray shielding means disposed adjacent to an envelope wall opposite from said one wall in the direction of incidence of the x-radiation; and said means for producing and deflecting said electron beam being disposed in a portion of said envelope displaced laterally from the envelope portion containing said face plate and said x-ray shielding means.

* * * * *